United States Patent [19]

Watanabe et al.

[11] 4,015,043

[45] Mar. 29, 1977

[54] ELECTROSTATIC RECORDING MATERIAL

[75] Inventors: Noritoshi Watanabe; Seigoro Fujita; Kazuo Shibata; Shiho Iwawaki, all of Hyogo; Hiromu Takeda, Shiga, all of Japan

[73] Assignees: Kanzaki Paper Manufacturing Co., Ltd.; Toray Industries, Inc., both of Tokyo, Japan

[22] Filed: Sept. 4, 1975

[21] Appl. No.: 610,379

[30] Foreign Application Priority Data

Sept. 9, 1974 Japan ..... 49-103703

[52] U.S. Cl. ..... 428/342; 428/522; 427/161; 427/121; 162/157 R; 162/148; 162/146

[51] Int. Cl.[2] ..... D21H 3/42; D21H 3/46; D21H 3/38

[58] Field of Search ..... 428/342, 522; 162/148, 162/146, 157 R; 346/135; 427/121, 161

[56] References Cited

UNITED STATES PATENTS

| | | | |
|---|---|---|---|
| 3,114,670 | 12/1963 | Iwasaki | 162/146 |
| 3,775,353 | 11/1973 | Kohne et al. | 162/157 R X |
| 3,928,496 | 12/1976 | Takeda et al. | 162/157 R X |
| 3,963,821 | 6/1976 | Takeda et al. | 162/157 R X |

*Primary Examiner*—Ralph S. Kendall
*Assistant Examiner*—Charles R. Wolfe, Jr.
*Attorney, Agent, or Firm*—Armstrong, Nikaido & Wegner

[57] ABSTRACT

The electrostatic recording material comprises an electroconductive transparentized base sheet having a dielectric layer thereon. The transparentized base sheet is obtained by subjecting to a transparentizing treatment with moisture, heat and pressure a fibrous matrix sheet of a mixture of natural pulp with synthetic pulp formed of a blended polymer system consisting essentially of polyvinyl alcohol-acrylonitrile copolymer and acrylonitrile-styrene copolymer.

13 Claims, No Drawings

ELECTROSTATIC RECORDING MATERIAL

BACKGROUND OF THE INVENTION

This invention relates to an improved electrostatic recording material, particularly to an electrostatic recording material which comprises a dielectric layer and an electroconductive transparentized base sheet supporting the dielectric layer.

The electrostatic recording system has recently been widely applied to a facsimile or a computer input-output system suitable for high speed recording in a high speed telecommunication system, a high speed graphic reproduction system, etc. The electrostatic recording material as a recording medium basically comprises a highly dielectric layer, which serves as an electric-charge-retentive layer, and an electroconductive base sheet which supports the dielectric layer. Electrostatic images of electrical signals formed on the dielectric layer are made visible with a developer comprising a toner and a carrier which has a polarity opposite to the polarity of the electrostatic image charge, and fixed as permanent visible images by further treatment.

The electrostatic recording system does not involve any photoelectric conversion in the process of forming electrostatic latent images on the dielectric layer. The electrostatic recording material of the invention, therefore, does not include any so-called photosensitive element.

There have been proposed various methods for forming electrostatic latent images on a dielectric layer. Among them there are a method of imparting electric signals on the dielectric layer by making it contact with an electroconductive material such as a metal; a method of transforming electrostatic latent images formed on the other medium to the electrostatic recording material, which is known as the "TESI" method and disclosed, for example, in PHOTOGRAPHIC SCIENCE AND ENGINEERING, Vol. 9, No. 1, January - February 1965; and a method of forming discharged patterns on the surface of the recording material with use of a photoconductive film as a switching element, which is known as the "WALCUP" method and disclosed, for example, in U.S. Pat. No. 2,833,930. The electrostatic recording material described can be used in any of those methods for forming electrostatic latent images.

The electrostatic recording system described, however, is distinct from the system for forming latent images by photoelectric conversion with the utilization of a photosensitive material in the recording sheet.

In the electrostatic recording system, it is very difficult to obtain multiple reproductions at one time. Therefore, the recorded electrostatic recording material is often used as a master copy for obtaining further multiple copies. In another case, a multiplicity of the electrostatic recording papers recorded with a facsimile or printer plotter are piled and used as a so-called overlay paper. To prepare the electrostatic recording material which is used for those purposes, commercially available tracing papers or glassine papers have been generally used as base sheets. However, such conventional base sheets involve some fatal disadvantages when used for the electrostatic recording material.

To obtain tracing paper or glassine paper having a desired transparency, beating of pulp must be carried out to an utmost extent until cellulose fibers are extremely fibrillated. Consequently, the fibers are injured to impair the paper making property and the physical strength of the paper obtained is unsatisfactory. In addition, since many hydroxy groups which are sensitive to moisture or water are exposed on the surfaces of the fibers as a result of a high fibrillation, the paper becomes well adsorptive of water and accordingly the dimensional stability of the paper is extremely degraded. Owing to those disadvantages, the workabilities for coating and processing in the manufacturing of the electrostatic recording material are significantly lowered. Moreover, the electrostatic recording material produced with use of the above conventional base sheet tends to curl by a change in moisture of the atmosphere or in contact with water and tends to be brittle during the process of fixing treatment with heat. These also lead to make difficult to handle and lower the workability. The above conventional tracing papers and glassine papers further have such a disadvantage that the adsorbed water which is combined with hydroxyl groups is vaporized and expanded for form bubbles in the paper when it is heated, which is the so-called blister phenomenon.

An object of the invention is to provide an improved electrostatic recording material in which the above disadvantages can be avoided.

Another object of the invention is to provide an electrostatic recording material having a high transparency which can be used as a master copy or an overlap paper for duplication.

Other objects and advantages of the invention will become apparent from the following detailed description.

SUMMARY OF THE INVENTION

The electrostatic recording material according to the invention comprises an electroconductive transparentized base sheet having a dielectric layer thereon. The transparentized base sheet is obtained by subjecting a fibrous matrix in the form of a sheet material to a transparentizing treatment with moisture, heat and pressure. The fibrous matrix consisting essentially of:

a. 6 to 60 parts by weight on dry basis synthetic pulp formed of a blended polymer system which consists essentially of 5 to 40% by weight of polyvinyl alcohol-acrylonitrile copolymer in which polyvinyl alcohol component is chemically bonded to a acrylonitrile component is chemically bonded to acrylonitrile component and the polyvinyl alcohol component content is 20 to 80% by weight, and 60 to 95% by weight of acrylonitrile-styrene copolymer in which the acrylonitrile component content is 5 to 45% by weight; and b. 94 to 40 parts by weight on dry basis of natural pulp.

DETAILED DESCRIPTION OF THE INVENTION

The synthetic pulp used in the invention is formed of a blended polymer system consisting essentially of 5 to 40% by weight of polyvinyl alcohol-acrylonitrile copolymer (hereinafter referred to as "PVA-AN copolymer") and 60 to 95% by weight of acrylonitrile-styrene copolymer (hereinafter referred to as "AN-S copolymer").

In the PVA-AN copolymer, polyvinyl alcohol (hereinafter referred to as "PVA") which is the hydrophilic component and acrylonitrile (hereinafter referred to as "AN") which is a hydrophobic component are chemically bonded to each other, for example, either in the form of a graft copolymer or in the form of a block copolymer. Preferably, the PVA-AN copolymer is a graft copolymer.

If desired, the blended polymer system may further include unreacted PVA in an amount of 23% or less by weight and/or an acrylonitrile polymer in an amount of 35% or less by weight each with respect to the total amount of the blended polymer system.

The PVA-AN graft copolymer which is used in this invention can be obtained by aqueous heterogeneous polymerization or solution homogeneous polymerization. The average degree of polymerization of PVA may be within the range of 500 to 3400, more preferably within the range of 600 to 1800. The degree of saponification of PVA is preferably 60% or more. The polymerization of PVA with AN to a graft copolymer may be carried out by dissolving PVA in a solvent for polymerization, for example, dimethyl sulfoxide; mixing and dissolving 25 to 500% by weight (based on the amount of PVA) of AN in the resultant PVA solution; and polymerizing them with use of a catalyst for polmerization, for example, persulfate at a room temperature or at a relatively low temperature such as 70° C or below. The final product after this polymerization, may include a PVA-AN graft copolymer, unreacted PVA and polyacrylonitrile.

In the reaction for obtaining the PVA-AN copolymer, a small amount of an AN polymer which is not bonded to the hydrophilic component and an unreacted hydrophilic component which is not bonded to AN may be produced as by-products. However the existence of those by-products in the blended polymer system would be harmless so far as the system includes the PVA-AN copolymer and the AN-S copolymer in the before mentioned amounts, respectively. Accordingly it is unnecessary to remove those by-products from the final product of polymerization for obtaining the PVA-AN graft copolymer. What is important is that the AN component and PVA component are chemically bonded to each other and the copolymer has the before mentioned PVA content, whereby it becomes possible to impart an excellent hydrophilic property, an excellent dispersibility in water and an excellent self-adhesive property to the resultant synthetic pulp. When the AN component and the PVA component are simply blended and exist in the system, it is impossible to impart such characteristics to the resultant synthetic pulp.

There may be an alternative polymerization method in which AN is added to an aqueous solution of PVS and then polymerization is carried out. The PVA-AN graft copolymer which is produced by this method can be isolated by reprecipitation and then filtration.

The PVA content in the graft copolymer should be within the range of 20 to 80% by weight, preferably within the range of 35 to 65% by weight. In case the PVA content is less than 20% by weight, the molecular weight of the grafted polyacrylonitrile component would become too large, impairing the processability and impeding the development of the hydrophilic property of the resultant synthetic pulp. On the other hand, if the PVA content exceeds 80% by weight, when the resultant fiber or pulp is made into an aqueous slurry, PVA would flow out into water and the slurry would cause foams which become obstacles to beating and paper making.

The use of PVA having an average degree of polymerization of less than 500 will result in decreasing the water resistance of the paper. On the other hand, if the average degree of polymerization of PVA used exceeds 3400, the hydrophilic property of the resultant fiber will be degraded and fibrillation will not be carried out smoothly, and accordingly the synthetic pulp having desired properties would never been obtained.

In preparing the PVA-AN copolymer, in addition to AN, less than 40 mol % of a vinyl monomer other than AN, but which is copolymerizable with AN, for example, vinyl acetate, methyl acrylate, styrene and vinyl chloride, may also be copolymerized.

The AN content in the AN-S copolymer used in the invention should be within the range of 5 to 45% by weight, preferably, within the range of 15 to 40% by weight. When this AN content exceeds 45% by weight, the compatibility of the AN-S copolymer with the PVA-AN copolymer would be too high, impairing the forms or characteristics of the resultant fibrils. On the other hand, when the AN content is less than 5% by weight, the solubility of the AN-S copolymer in a solvent (dimethyl sulfoxide) is reduced, and accordingly a spinnable concentrated solution of the blended copolymers cannot be formed. Therefore, the uniform synthetic pulp cannot be obtained.

The AN-S copolymer which is used in the invention can be prepared through the utilization of any of conventional techniques of random copolymerization such as an aqueous heterogeneous polymerization and a mass polymerization.

The blended polymer system for the synthetic pulp according to the invention comprises 5 to 40% by weight of a PVA-AN copolymer and 60 to 95% by weight of such an AN-S copolymer. If the amount of the PVA-AN copolymer is less than 5% by weight, it is difficult to fibrillate the fibers by beating, and the fibers will have only low hydrophilic property. When such synthetic pulp is mixed with wood pulp to make a paper, the paper having excellent physical properties could not be obtained. On the other hand, if the amount of the PVA-AN copolymer exceeds 40% by weight, both the water resistance and the dimensional stability to moisture of the resultant paper would be decreased.

It is not desirable that the amount of AN-S copolymer is less than 60% by weight because the coagulation ability of the fibers in a coagulation bath is reduced.

The blended polymer system for the synthetic pulp is never limited to those consisting of said two copolymers only. The system may contain unreacted PVA and an AN polymer produced as by-products in the process of the graft copolymerization and may further contain another acrylonitrile polymer.

A greater part of unreacted PVA are removed in the state of an aqueous slurry in the process of making fibers and pulp. However, the amount of PVA in the blended polymer system initially prepared should not exceed 23% by weight. If the amount of unreacted PVA exceeds 23% by weight, it will cause to produce foams in the aqueous slurry.

The amount of the AN polymer in the blended system prepared should not exceed 35% by weight. If the AN polymer amount exceeds 35% by weight, the excessive fibrillation would be caused.

As to the addition of an AN polymer to the blended polymer system, a separately prepared linear polymer may be used. One having a molecular weight of about 20,000 to 100,000 is preferable. It may contain the aforementioned vinyl monomers which can be used in the copolymerization as a copolymerizable component in such an amount within the range not exceeding 40 mol %.

Among the methods for preparing synthetic pulp from the above mentioned blended composition, there are included a method of beating fibers produced from the above system and a method for preparing pulp materials directly from the blended polymer composition.

As methods for producing fibers, there may be included a flush spinning method and an emulsion flush spinning method in addition to the conventional spinning methods such as a wet spinning method, a dry wet spinning method and a phase separation spinning method. Among them the wet spinning method is most preferable. A further explanation of the wet spinning method will be given below.

The composition including the PVA-AN copolymer and the AN-S copolymer is dissolved in a solvent such as dimethyl sulfoxide. This solution is then wet spun by a conventional method into an aqueous spinning bath, of example, an aqueous solution of dimethyl sulfoxide containing up to the maximum of 80% by weight of dimethyl sulfoxide to produce an undrawn watercontaining gel filament. Such undrawn filament may be drawn in a hot water bath or in an atmosphere of steam. Further, the drawn filament may be subjected to a heat treatment for fixing its length or relaxing in a hot water bath or in an atmosphere of steam.

A draw ratio is preferably more than 3.0, but this is not intended to limit the scope of the present invention. The use of the undrawn filament is not harmful to achieve the objects of the invention. However, in the case of using the undrawn filament, it is necessary to pay close attention to handle it because the undrawn filament has a low strength.

Referring to the heat treatment for relaxation, a relaxation ratio is preferably more than 45%, but this is not intended to limit the scope of the invention. By such procedures, a fine pulp having a good dispersibility is easily obtained. When the draw ratio is not more than 3.0, the filament which is subjected to such heat treatment is rather cut than fabrillated in the process of beating. However, when the beating is carried out without subjecting the filament to the heat treatment, the objects of the invention can be achieved with the draw ratio being not more than 3.0.

What is important is that the above fibrous material consists of a hydrophilic component (PVA-AN graft copolymer) and a hydrophobic component (AN-S copolymer) and that the hydrophilic component is dispersed in the hydrophobic component and exists in the form of being arranged as an independent phase in the direction of fiber axis.

Such fibrous material is easily fibrillated by beating, and accordingly a pulp or pulp like material having an excellent hydrophilic property, a dispersibility in water, and a self-adhesive property can be obtained.

The obtained filaments are then be cut into staple fibers having a length of 1.0 to 25 mm.

Instead of the aforementioned heat treatment prior to the process of cutting, fibers may be subjected to a heat treatment in a hot water or in an atmosphere of steam. In such a case, it is desirable that the temperature for the treatment is within the range of 90° to 120° C and treatment time is within the range between 30 seconds and 8 minutes, however those are not intended to limit the scope of the invention.

The fibers which are obtained according to the above method can easily be fibrillated by means of beating which is usually applied to wood pulp, and may be made into pulp having an excellent dispersibility in water.

The above staple fibers are made into aqueous dispersion having a concentration of 1 to 20% by weight and subjected to a beating treatment by use of the conventional beating devices such as beaters, refiners, PFI mills and ball mills.

The synthetic fiber prepared according to the invention has a self-bondable microfibril structure. The pulp particles are entangled each other by the above micrifibrils. Each of the fibers may have a diameter of 0.01 to 5 microns, preferably 0.05 to 3.0 microns at its minimum dimension portion. The length of each of the fibers may be more than five times, preferably twenty times, an average diameter.

The synthetic pulp may be solely or partly of a latent microfibril structure. The above term "latent microfibril structure" refers to fibrous material itself obtained according to the invention, or to the fibrous material a part of which is crushed in the process of beating and is present in the form of microfibrils. Namely, the latent microfibril structure is a precursor which can be entirely converted to the microfibrils with sufficient beating. When the beating with use of the conventional beating device is carried out to such an extent that the beaten fibrous materials become suitable for forming a paper like sheet, a greater part of the pulp material is occupied by the microfibril structure. In the process of beating, powder like minute particles which are smaller in size than the above microfibrils may be produced as by-products, but those are not essential to the invention.

When the minimum dimension of the above microfibril does not meet such requirements that the diameter is at least 0.01 microns and the length is more than five times the average diameter, the entanglement of the pulp particles is degraded, and accordingly the strength and texture of the resultant paper are impaired.

Since the pulp material of the invention contains the microfibril structures and the latent microfibril structures, the freeness of the pulp can be controlled at will by varying the beating conditions. In addition, a paper having an excellent wet strength is obtained without any additives such as binder since the microfibrils have the self-adhesive property.

The structure of the synthetic pulp prepared according to the invention may be defined by a freeness which is determined according to Japanese Industrial Standard JIS P-8182 with use of Canadian Standard Freeness testing machine. The freeness of the pulp material of the invention should be within the range of 50 to 600cc, preferably within the range of 100 to 400cc. When the freeness is less than 50cc, the tear strength of the resultant paper is lowered and the paper making speed is lowered to such an extent that the paper making is substantially impossible. On the other hand, the freeness exceeds 600cc, the pulp loses the paper making ability, and a paper having a good texture, a good surface uniformity and good physical properties is not obtained.

The transparentized base sheet according to the invention is obtained by subjecting a sheet comprising 6 to 60 parts by weight on dry basis of the above synthetic pulp and 94 to 40 parts by weight on dry basis of natural pulp to a transparentizing treatment with moisture, heat and pressure.

As the natural pulp, wood pulp is most preferably used, but other natural pulp such as one which is prepared from bast fibers or animal fibers may also be used.

If the amount of the synthetic pulp is less than 6 parts by weight, the resultant base sheet is not sufficient for practical use in the respects to its transparency, wet-strength, tensile strength and dimensional stability, though these properties of the base sheet are improved when compared with a transparent base sheet consisting of the conventional natural pulp only. On the other hand the amount of the synthetic pulp exceeds 60 parts by weight, the mechanical strength becomes uneven, especially the tear strength and the folding strength are reduced. Preferably, the sheet is formed of 10 to 50 parts by weight of synthetic pulp and 90 to 50 parts by weight of natural pulp.

The synthetic pulp and the natural pulp mixed in the above proportions are made into a sheet with use of a conventional wet system paper making machine. In the process of the paper making, the conventional additives such as sizing agents, fixing agents, releasing agents, electroconductive agents, fillers and dyestuffs may be added to the system.

Application in the paper making process of starch, polyvinyl alcohol, carboxymethyl cellulose, sodium alginate, solutions or emulsions of synthetic resins or conventional transparentizing agents may also be carried out by size-pressing, impregnation or coating.

The weight of the resultant sheet material may be controlled within the range 25 to 150g/m$^2$, preferably within the range of 30 to 100 g/m$^2$, but this is not intended to limit the scope of the invention.

The thus obtained sheet material is then transparentized by moistening the sheet to a moisture content within the range of 5 to 40%, and then passing it through a pressure equipment having a surface temperature of above 130° C to impart heat and pressure. The moisture content is given by the following formula:

$$\text{Moisture content} = \frac{\text{Weight of water contained in the sheet}}{\text{Weight of the sheet containing water}} \times 100$$

If the moisture content is less than 5%, a uniform transparency of the sheet is not obtained. While, when the moisture content exceeds 40%, the physical strength of the sheet is reduced, causing adhesion to the roll of the pressure equipment and making troubles such as a break. Among the typical moistening methods, there may be included a method of coating water by coater, a method of spraying water and so-called electrostatic moistening method. In the moistening process, various additives such as sizing agents, releasing agents, electroconductive agents, dyestuffs and transparentizing agents may be added to water.

For the pressing treatment any conventional means such as a super calender and a machine calender, an equipment having two rolls which form a nip, and a hot press type equipment may be utilized.

In the process of transparentizing treatment with use of those equipments the sheet material is pressed at least one time by a pressure equipment having a surface temperature of 130° C or above, whereby a desired transparency of the sheet is obtained. However, in view of the fact that the synthetic polymers which constitute the synthetic pulp are decomposed at about 250° C, it is necessary to be careful so as not to raise the temperature of the sheet to above 250° C. The pressure which is applied to the sheet material is controlled at will depending on the thickness of the sheet, the mixing ratio of pulps and the conditions of moistening. But it may be usually within the range of about 100 to 500 kg/cm, preferably about 120 to 400 kg/cm.

The electrostatic recording material according to the invention has such various advantages as described below, as compared with known electrostatic recording material in which a conventional glassine paper is used as a base sheet.

The synthetic pulp described can be uniformly dispersed in the sheet in the form of microfibrils having numerous micro voids and has hydrophilic moieties in itself. Therefore, the water contained in the sheet functions as a plasticizer not only for natural pulp but also for synthetic pulp. In addition, when the sheet is subjected to the treatment with heat and pressure, the water contained in the sheet is removed accompanying air which is filled in the micro voids, whereby an inherent clarity of the polymers which constitute the synthetic pulp are developed effectively, and accordingly an excellent transparency is obtained. According to the invention, it is not necessary to use a heavily beaten pulp, for example, one having a CSF (Canadian Standard Freeness) of 50 to 150cc, which is conventionally used to make a usual glassine paper, as the natural pulp to be mixed with the above synthetic pulp. According to the invention, the desired transparency can be obtained with use of usually or slightly beaten pulp. Consequently, the disadvantages involved with the use of the above heavily beaten pulp, such as a decrease in the physical strength, a decrease in the dimentional stability against moisture or water and the blister phenomenon can be avoided.

To form a dielectric layer of electrostatic recording material, a coating composition comprising dielectric polymeric materials such as homopolymers or copolymers of vinyl monomers such as vinyl chloride, vinyl acetate, vinyl acetal, vinylidene chloride, ethylene, styrene, acrylates and methacrylates; silicone resin; polyurethane; alkyd resin; epoxy resin; chlorinated rubber and etc. dissolved in an organic solvent such as benzene, toluene, xylene, ketones such as methyl ethyl ketone and methyl isobutyl ketone, ethyl acetate and etc. is coated on a base sheet. In such a case, a barrier layer of carboxymethyl cellulose or polyvinyl alcohol is usually formed for the purpose of preventing the penetration of a coating composition into the paper sheet, and of forming a uniform dielectric thin layer. However, this has inevitable disadvantages of decreasing the recording characteristics, increasing the number of processes and high cost. According to the invention, it is not always necessary to form a barrier layer because the synthetic pulp swells with benzene, toluene, xylene or ketones to fill up the voids in sheet matrix, whereby the base sheet having an excellent resistance to solvent is obtained.

Since the above organic solvent system coating compositions are disadvantageous in the respects of inflammability, toxicity, handling, and workability, aqueous dispersion system coating compositions have been proposed. However, when an aqueous dispersion system coating composition is applied to the conventional glassine paper, the paper curls owing to its poor dimensional stability against moisture or water, and accordingly it is not practically useful. On the contrary, the transparentized paper according to the invention has an excellent stability to water, therefore, any aqueous dispersion system coating composition can be applied without any trouble to the operation. Since the surface of the base sheet according to the invention has an affinity to water due to the hydrophilic components contained in the synthetic pulp, the aqueous dispersion system coating composition hardly penetrates into the paper at the short period between coating and drying but it forms a dielectric thin layer. Therefore, it is not necessary to provide an additional barrier layer in the base sheet.

As the coating compositions for forming the dielectric layer of the electrostatic recording material according to the invention, both organic solvent systems and an aqueous dispersion systems can be employed. As the embodiments of such coating compositions there may be organic solvent solutions and aqueous dispersions containing polymers such as homopolymers or copolymers of vinyl monomers such as vinyl chloride, vinyl acetate, vinyl acetal, vinylidene chloride, ethylene, styrene, butadiene, acrylates, methacrylates, acrylonitrile and chrotonic acid; silicone resin; polyesters; polyurethane; alkyd resins; epoxy resins; chlorinated rubbers and mixtures thereof. However, this invention is not limited to those polymers and it is possible to use the other insulating resins at will. The coating composition may further contain conventional additives, for example, additive for improving a mat-finishing effect, a writability and a printability such as inorganic pigments such as calcium carbonate, barium sulfate, alminum oxide, natural clays and calcined clays, and fine powder thereof whose surface is treated with various natural and synthetic hydrophobic materials, and fine particles of polymer such as polystyrene; dispersing agents such as phosphates and sodium alkyl naphthalene sulfonate; viscosity controlling agents such as polyvinyl alcohol, carboxymethyl cellulose, gum arabic and gelatin; plasticizers; and dyes, in such amounts that the dielectric property of the dielectric layer is not impaired.

The coating is carried out with use of a conventional coating equipments such as an air knife coater, a roll coater, a blade coater and etc. The amount of coating is within the range of 3 to 20 g/m², preferably 5 to 10 g/m², on dry basis, but this is not intended to limit the scope of the invention.

Referring to the electroconductive treating for the base sheet, known electro conductive agents such as inorganic salts; carbon black, fine powder of aluminum, copper, nickel, etc., and polymeric electrolytes prepared, for example, from vinylbenzyl quaternary ammonium salt, sodium alignate, sodium polyacrylate, sodium polymethylene sulfonate, etc., can be used. It is not necessary to pay any special regard on the application of those electroconductive agents. Those are applied by adding to the pulp composition or by adding to the sizing solution in the process of paper making. Further, those may be applied to the base sheet by coating or size pressing simultaneously with moistening in the process of transparentizing treatment, or by size pressing, impregnating or coating transparentized base sheet therewith.

Referring to the surface resistivity of the treated base sheet, it is preferably within the range of $10^5$ to $10^{11}$ ohm.

The transparency ratio of the resultant electrostatic recording material may be controlled depending on its use. For example, when it is used as a master for duplication, the transparency ratio is generally controlled at more than 50%. The transparency ratio is given by the following formula:

$$\text{Transparency ratio} = 100 - (\text{value of opacity})$$

wherein the value of opacity is measured by Hunter reflectometer according to JIS P-8138.

The invention will be further illustrated by reference to the following examples, however, the invention is not limited to those examples but includes wide variations.

Unless otherwise indicated, parts and % signify parts by weight and % by weight, respectively.

EXAMPLE 1

A PVA-AN graft copolymer in which the ratio of PVA to AN is 50/50 was obtained by grafting AN to PVA having a degree of polymerization of 1400 according to an ordinary radical polymerization method with use of persulfate salt as a catalyst.

An AN-S copolymer in which the ratio of AN to styrene is 24/76, having intrinsic viscosity of 0.54 (determined in MEK at 30° C) was obtained according to a conventional suspension polymerization.

One part by weight of the above PVA-AN graft copolymer and 4 parts by weight of the above AN-S copolymer were dissolved in 15 parts by weight of dimethyl sulfoxide (hereinafter referred to as "DMSO") to obtain a 25% spinning solution.

A wet spinning with that solution was carried out in a water DMSO (45/55) bath from a spinning nozzle having a diameter of 0.08 mm to obtain a continuous filament having a denier of 7 and a PVA content of 10%. The draw ratio was 2 times. Thus obtained filament was cut into staple fibers having a length of about 10 mm and the fibers are then beaten with use of a single discrefiner under the conditions of a pulp concentration of 3% and the clearance of 50 microns to obtain a synthetic pulp (A) whose CSF was 200 cc. The average diameter of the fibrils was 8 microns, the minimum diameter in the fibril was 0.5 microns and the ratio of the length by the average diameter was about 50.

Separately, bleached broad-leaves wood kraft pulp (L) having a CSF of 480 cc, bleached needle-leaved wood pulp (N) having a CSF or 350 cc, heavily beaten bleached needle-leaved wood kraft pulp (N′) having a CSF or 100 cc and heavily beaten bleached broad-leaved wood kraft pulp (L′) having a CSF of 120cc were prepared. The above synthetic pulp (A) and the natural pulp (L) (N) (L′) (N′) were formed into a sheet with a manual papermaking sheet machine (with 80 mesh metal screen) manufactured by Toyo Seiki Co., Ltd. according to the formulations shown in the following Table 1.

The moisture contents of the thus obtained dry sheets were controlled as shown in Table 1 by applying water to the sheets with a wire wound coating rod. Then, the sheets were subjected to a transparentizing treatment in which the sheets were made to pass through a nip of a two stack pressure equipment provided with an elastic roll and a hard chrome plated metal roll (surface temperature at 150° C) under the linear pressure of 135 kg/cm for four times in all, reversing the sheet upside-down. Various characteristics of the obtained transparent papers are shown in Talbe 1.

On the one side surface of each transparentized paper, a mixture solution for electroconductive treatment containing polyvinylbenzyl ammonium chloride (Product of Dow Chemical Co., Ltd., ECR-34) and oxidized starch at the ratio of 40 : 60 on dry basis was coated by the weight of 3g/m² on dry basis with use of a wire wound coating rod. On the other side of the paper, an organic solvent coating composition containing a copolymer of vinyl chloride and vinyl acetate (product of Denki Kagaku Kogyo Co., Ltd., (known as the trade name "DENKALAC") and calcium carbonate fine powder at the ratio of 60 : 40 on dry basis dissolved or dispersed in a mixed solvent of toluene and methyl ethyl ketone (MEK) having a mixing ratio of 1:1 was coated by the weight of 6g/m² on dry basis with use of a wire wound coating rod to obtain an electrostatic recording material having a transparency.

On the thus obtained electrostatic recording material, latent images were formed by applying pulse signals of -800V, 50 microsec. from a multi-styli electrode having a line density of 4 lines/mm. Then, a magnetic blush development was carried out with use of dry toner which was mixed with iron powder to obtain visible images. The reverse side of this recorded material was made to be in contact with a hot plate which is heated at 120° C to melt the toner. Various characteristics of the resultant electrostatic recording material were shown in Table 1.

In the examples according to the invention, the electrostatic recording materials were obtained without any trouble during the process of preparation. The recording materials obtained in these examples had a high degree of transparency, good physical strengths and good dimensional stability to moisture and water. They further had an excellent recordability and accordingly clear images were obtained. In addition, there was no trouble in the process of fixing with heat. The recorded material had a good suitability for a master for diazotyp copying.

To the contrary, the recording material obtained in Control 1-1 was inferior in the transparency ratio and had poor resistance to solvent, and accordingly the pinhole-like defects in the recorded images owing to the ununiformity of surface of dielectric layer were remarkably appreciated. The recording material obtained in Control 1-2 had almost the same defects as in Control 1-1. The recording material obtained in Control 1-3 was disadvantageous in the respect of physical strength though it had an excellent transparency. The recording material of Control 1-4 had such a disadvantage that a remarkable curl was caused in the process of electroconductive treatment, impending the workability. Further, it lacked a dimensional stability to moisture or water, and the pinhole-like defects in the recorded images were remarkably appreciated. Furthermore, the appearance of the recording material was extremely impaired because the blisters occurred in the paper in the process of fixing with a hot plate which was heated at 120° C.

EXAMPLE 2

Two kinds of filaments having PVA contents of 30% and 10% respectively, were made by a conventional spinning method similar to that described in Example 1 from a 25% solution in DMSO of a mixture of one part by weight of a PVA-AN copolymer obtained by grafting AN to PVA having a degree of polymerization of 1800 according to an ordinary radical polymerization method wtih use of persulfate salt as a catalyst in which the ratio of PVA/An is 80/20, with 1.67 and 7 parts respectively by weight of an AN-S copolymer having an intrinsic viscosity of 0.65 determined in MEK at 30° C which is obtained by a conventional suspension polymerization method, in which the ratio of AN/styrene is 30/70. The draw ratio was 3.5 times and each of the obtained two kinds of filaments had a denier of 5. The filaments were cut into staple fibers having a length of about 3 mm and the staple fibers were then beaten in the same manner as in Example 1, respectively, to obtain two kinds of synthetic pulp. One was a synthetic pulp (B) whose PVA content was 30% and having a CSF of 195 cc, and the other was a synthetic pulp (C) whose PVA content was 10% and having a CSF of 240cc. The average diameter of the fibrils having a PVA content of 30% was 2 microns, the minimum diameter in the fibril was 0.2 microns and the ratio of the length by the average diameter was about 90, and the average diameter of the fibrils having a PVA content of 10% was 4 microns, the minimum diameter in the fibril was 0.3 microns and the ratio of the length by the average diameter was about 70. The bleached broad-leaved wood kraft pulp (L) and the bleached needle-leaved wood kraft pulp (N) prepared in Example 1were mixed with the above synthetic pulp (B) or (C) in such a proportion that B or C/N/L was 30/55/15. The resultant mixed pulp was made into two sheets in the same manner as in Example 1.

The moisture contents of the thus obtained dry sheets were controlled at the value shown in Table 2 in the same manner as in Example 1. Then, the sheets were subjected to a transparentizing treatment in which the sheets were made to pass through the nip of the two stack pressure equipment provided with an elastic roll and a hard chrome plated metal roll (surface temperature at 140° C) under the linear pressure of 220kg/cm for four times. Various characteristics of the obtained transparent papers are shown in Table 2.

One side surface of the resultant papers were subjected to a conductive treatment in the same manner as in Example 1. On the other side surface each, an aqueous dispersion of polymer havng a concentration of 30%, which obtained by mixing 50 parts (on dry basis) of an aqueous solution (I) of ammonium salt of copolymer consisting of 30.9 mol% of butadiene, 24.0 mol% of styrene, 20.8 mol% of methyl methacrylate and 24.3 mol% of methacrylic acid, with 50 parts (on dry basis) of aqueous dispersion (II) (weight average particle diameter at 12,000A, the lowest film-forming temperature at 96° C) which was obtained by suspension polymerizaton of 92 parts of styrene in an aqueous ammonium solution containing 8 parts of copolymer consisting of 19.0 mol% of styrene, 66.0mol% of methyl methacrylate and 15.9 mol% of methacrylic acid, was coated to form a dielectric layer of about 6 microns in thickness.

Each of the resultant electrostatic recording materials had a high transparency, a good physical strength and a good dimensional stability to moisture or water. The latent images were formed on the electrostatic recording material by applying pulse signals of −700V and 10 microsec. with use of a single stylus scanning recording equipment having aline density of 6 lines/mm. Then, the latent images were developed with a liquid developer to obtain clear images without any background. The electrostatic recording materials of the invention were recorded by an alternative recording method, in which the latent images formed on the surface of available sensitized paper with zinc oxide by an electrophotographic method were transferred to the surface of the electrostatic recording material of the invention by a short circuit method without applicaton of bias. After development of the transfered latent images by magnetic blush method, fixing treatment was carried out to obtain clear images. Those recorded materials were very useful for a master for diazo-type copying.

EXAMPLE 3

Two kinds of filaments having PVA contents of 7% and 20% respectively, were made by a wet spinning method similar to that disclosed in Example 1 from a 25% solution in DMSO of a mixture of one part of a PVA-AN graft copolymer obtained by grafting AN to PVA having a degree of polymerization of 1100 according to an ordinary radical polymerization method with use of persulfate salt as a catalyst in which the ratio of PVA/AN was 60/40, with 7.57 and 2 parts, respectively, of an AN-S copolymer having an intrinsic viscosity of 0.65 determined in MEK at 30+ C which was obtained by a conventional mass polymerization method, in which the ratio of AN/styrene was 20/80.

The obtained two kinds of filaments had the same denier of 10. Those filaments were cut into staple fibers having a length of aboout 5 mm and the staple fibers are then beaten in the same manner as in Example 1 to obtain two kinds of synthetic pulp. One was a synthetic pulp (D) whose PVA content was 7% having a CSF of 230 cc, and the other was a synthetic pulp (E) whose PVA content was 20% having a CSF of 200 cc. The average diameter of the fibrils having a PVA content of 7% was 13 microns, the minimum diameter in the fibril was 0.8 microns and the ratio of the length by the average diameter was about 45, and the average diameter of the fibrils having a PVA content of 20% was 8 microns, the minimum diameter in the fibril was 0.5 microns and the ratio of the length by the average diameter was about 55. The bleached broad-leaved wood kraft pulp (L) and the bleached needle-leaved wook kraft pulp (N) prepared in Example 1 were mixed with above synthetic pulp (D) or (E) in such a proportion that D or E/N/L was 25/50/25. The resultant mixed pulp was made into two sheets with use of a Fourdrinier test machine manufactured by Mitsubishi Kakoki Co., Ltd. according to the formulation shown in Table 3.

The moisture contents of the obtained dry sheets were controlled at the values shown in Table 3 by coating water with a pilot coater. Then the sheets were subjected to a transparentizing treatment in which the sheets were made to pass through four nips of super calender provided with alternating chilled rolls having a surface temperature of 160° C and cotton rolls under the condition of linear pressure at 220 kg/cm. Various characteristics of the obtained transparent sheets are shown in Table 3.

The electroconductive treatment of the sheets were carried out in the same manner as in Example 1, and then a dielectric layer was formed in the same manner as in Example 2 to obtain electrostatic recording materials. The recordability of each recording material was evaluated in the same manner as in Example 2. Each of the obtained electrostatic recording materials had a high transparency, a good physical strength and a good dimensional stability to moisture or water. In addition the clear images were obtained without background.

EXAMPLE 4

A continuous filament having a denier of 7 and having a PVA content of 7% was prepared by a conventional spinning method similar to that in Example 1 from a 25% solutions in DMSO of a mixture of one part of a PVA-AN graft copolymer obtained by grafting AN to PVA having a degree of polymerization of 2600 according to an ordinary radical polymerization method with use of persulfate salt as a catalyst, in which the ratio of PVA/AN was 30/70, with 3.29 parts of an AN-S copolymer having an intrinsic viscosity of 0.54 determined in MEK at 30° C which was obtained by a usual suspension polymerization method, in which the ratio of AN/styrene was 24/76. The obtained filament was cut into staple fibers having a length of about 10 mm and then the staple fibers were beaten in the same manner as in Example 1 to obtain a synthetic pulp (F) having a CSF of 280 cc. The average diameter of the fibrils was 13 microns, the minimum diameter in the fibril was 08 microns and the ratio of the length by the average diameter was about 45.

The bleached needle-leaved wood kraft pulp (N) and the bleached broad-leaved wood kraft pulp (L) which were used in Example 1 were mixed with the above synthetic pulp (F) in such proportions as shown in Table 4. The resultant mixed pulp was made into two sheets with a Fourdrinier test machine manufactured by Mitsubishi Kakoki Co., Ltd. at a rate of 20m/min. The moisture contents of the resultant dry sheets were controlled at the value shown in Table 4 by spraying 3% aqueous solution of glycerin as a plasticizer with use of a spray-type damping equipment attached to a pilot coater. Then, the sheets were made to pass through 4 nips of a super calender provided with alternatively arranged chilled rolls having a highest surface temperature of 150° C and cotton rolls under the linear pressure of at most 200 kg/cm to obtain a transparentized papers. The properties of the obtained transparent papers are shown in Table 4.

The opposite surfaces of each of the obtained transparent sheets were coated with a conductive treatment solution containing polyvinylbenzyl ammonium chloride (product of Dow Chemical Co., Ltd., ECR-34) and oxidized starch at the ratio of 50:50 on dry basis by the weight of lg/m² on dry basis, respectively. Then, on one side surface of each of the resultant sheets, a coating composition containing polyvinyl butyral having a degree of butyralization of 73% and barium sulfate at the ratio of 70:30 on dry basis dissolved or dispersed im a mixed solvent of isopropyl alcohol and methyl ethyl ketone having a mixture ratio of 1:1 was coated by weight of 6g/m² on dry basis to obtain an electrostatic recording materials having a transparency.

The recordability of each of the obtained electrostatic recording materials was evaluated in the same manner as in Example 1, and good results were obtained. To the contrary, the electrostatic recording material obtained in Control had a poor workability in the process of super calendering due to its poor physical strength. In addition, corrugations were appreciated on the resultant recording material and white-spots were further appreciated in the recorded images.

EXAMPLE 5

A continuous filament having a PVA content of 28% was made by a wet spinning method similar to that described in Example 1 from a 25% solution in DMSO of a mixture of one part of a reaction product obtained by grafting AN to PVA having a degree of polymerization of 1800 according to an ordinary radical polymerization method with use of persulfate salt as a catalyst, which consisted of 74% by weight of PVA-AN copolymer (75/25), 20% by weight of unreacted PVA and 6% by weight of a homogeneous acrylonitrile polymer, with 1.7 parts of an AN-S copolymer (having an intrinsic viscosity of 0.71 determined in MEK at 30° C) which was obtained by a conventional suspension polymerization method, in which the ratio of AN/styrene was 15/85. The obtained filament having a denier of 7 was cut into staple fibers having a length of about 5mm and the staple fibers were then beaten in the same manner as in Example 1 to obtain a synthetic pulp (G) having a CSF of 240cc. The average diameter of the fibrils was 4 microns, the minimum diameter in the fibril was 0.3 microns and the ratio of the length by the average diameter was about 70.

Separately, a bleached needle-leaved wood kraft pulp (N''') having a CSF of 550cc and a bleached broad-leaved wood kraft pulp (L''') having a CSF of 620cc were prepared. The above synthetic pulp (G) and the natural pulps (N''') and (L''') were mixed and made into two sheets under the conditions shown in Table 5. As a Control, a sheet composed of the above natural pulps (N''') and (L''') only was prepared under the condition shown in Table 5.

The moisture contents of the resultant sheets were adjusted at the values shown in Table 5 by coating a 11% aqueous solution containing sodium chloride as an electroconductive agent on one side surface of the sheet with use of a wire wound coating rod. Then the sheets were made to pass through a two stack type calender provided with an elastic roll and a hard chrome plated metal roll (surface temperature at 150° C) four times under linear pressure of 210kg/cm, reversing both sides of the sheets, to obtain transparentized papers. The properties of the resultant papers are shown in Table 5.

On the other side surface which was not coated with the above aqueous solutions, a coating compositions obtained by mixing an ammoniacal aqueous dispersion containing 100 parts of butadiene-styrene (20:80) copolymer and 14 parts of butadiene-methyl methacrylate-methacrylic acid (30:55:15) copolymer, with silicone-coated kaolin at the mixing ratio of 1:1 on dry basis was coated by weight of 7g/m² on dry basis to obtain an electrostatic recording material having a transparency. The recordability of each of the resultant electrostatic recording materials was evaluated in the same manner as in Example 2. Each of the electrostatic recording materials in this Example had excellent characteristics compared with that in Control. The electrostatic recording material in Control had not a sufficient transparency, and the white-spots in the recorded images were remarkably appreciated.

EXAMPLE 6

A continuous filament having a PVA content of 10% was made by a wet spinning method similar to the disclosed in Example 1 from a 25% solution in DMSO of a mixture of one part of a PVA-AN graft copolymer obtained by grafting AN to PVA having a degree of polymerization of 800 according to a conventional radical polymerization with use of persulfate salt as catalyst, in which the ratio of PVA/AN was 40/60, with 3 parts of an AN-S copolymer having an intrinsic viscosity of 0.75 determined in MEK at 30° C and having a ratio of AN/styrene at 20/80, which was obtained by a common suspension polymerization method. The draw ratio was 2.0 times.

The resultant filament having a denier of 10 was cut into staple fibers having a length of about 5 mm, and the staple fibers were then beaten in the same manner as in Example 1 to obtain a synthetic pulp (H) having a CSF of 260cc. The average diameter of the fibrils was 7 microns, the minimum diameter in the fibril was 0.5 microns and the ratio of the length by the average diameter was about 50.

The same bleached needle-leaved wood kraft pulp (N''') and bleached broad-leaved wood kraft pulp (L''') as those which used in Example 5 were prepared.

The above synthetic pulp and natural pulps (N''') and (L''') were mixed at the mixing ratio shown in Table 6 and then made into three sheets with use of a commercially available Fourdrinier paper machine provided with a wire cloth having a width of 1975 mm, at a paper-making rate of 80m/min.

As a control, a sheet composed of the above natural pulps (N''') and (L''') only was prepared in the same manner as the above.

The moisture contents of each sheet thus prepared was adjusted at the value shown in Table 6 by coating a 0.2% aqueous solution containing a commercially available wax emulsion as a releasing agent with a commercially available bar coater. Then, the each sheet was made to pass 10 nips of a super calender provided with alternatively arranged chilled rolls having a highest surface temperature of 160° C and cotton rolls under the linear pressure of at most 250kg/cm in all to obtain a transparentized paper. The properties of the resultant transparent papers are shown in Table 6.

Each of the thus obtained transparent papers was subjected to the electroconductive treatment in the same manner as in Example 1. The recordability of each of the electrostatic recording materials was evaluated in the same manner as in Example 2. The obtained electrostatic recording material has good properties. To the contrary, the electrostatic recording material obtained in Control had not a sufficient transparency, and the recorded images thereon was uneven in image density and white-spots were remarkably appreciated.

Table 1

| Sheet forming | | | | | Properties of transparent paper | | | | | | Properties of electrostatic recording material | | | |
|---|---|---|---|---|---|---|---|---|---|---|---|---|---|---|
| Pulp composition on dry basis | Rosin sizing | 1) Talc filler % | Weight of sheet g/m² | Moisture content % | Bulk density g/cm³ | 2) Transparency ratio % | 3) Breaking length km | 4) Tear factor | 5) Expansion in water % | 6) Workability | 2) Transparency ratio % | 7) Heat fixing ability | 8) Surface potential (volt) | 9) Recorded images |
| A/N/L | | | | | | | | | | | | | | |

Table 1-continued

| | Sheet forming | | | | | Properties of transparent paper | | | | | | Properties of electrostatic recording material | | | |
|---|---|---|---|---|---|---|---|---|---|---|---|---|---|---|---|
| | Pulp composition on dry basis | Rosin sizing | 1) Talc filler % | Weight of sheet g/m² | Moisture content % | Bulk density g/cm³ | 2) Transparency ratio % | 3) Breaking length km | 4) Tear factor | 5) Expansion in water % | 6) Workability | 2) Transparency ratio % | 7) Heat fixing ability | 8) Surface potential (volt) | 9) Recorded images |
| Control | | | | | | | | | | | | | | | |
| 1–1 | 0/30/70 | No | 0 | 60 | 30.3 | 1.10 | 39.1 | 7.63 | 54 | 1.93 | Very bad | 36 | Good | −75 | Very bad |
| 1–2 | 5/50/45 | No | 0 | 30 | 28.5 | 1.08 | 51.2 | 7.31 | 50 | 1.68 | Bad | 48 | " | −80 | Bad |
| Example | | | | | | | | | | | | | | | |
| 1–1 | 7.5/50/42.5 | No | 0 | 40 | 22.5 | 1.07 | 63.4 | 7.34 | 48 | 1.51 | Good | 62 | " | −120 | Good |
| 1–2 | 10/50/40 | No | 0 | 30 | 31.6 | 1.08 | 66.1 | 7.42 | 48 | 0.91 | " | 64 | " | −124 | " |
| 1–3 | 25/30/45 | Yes | 6.0 | 40 | 18.1 | 1.09 | 73.8 | 7.16 | 44 | 0.65 | " | 72 | " | −125 | " |
| 1–4 | 30/30/40 | No | 0 | 60 | 17.2 | 1.01 | 75.6 | 7.72 | 43 | 0.38 | " | 73 | " | −123 | " |
| 1–5 | 60/40/0 | No | 0 | 80 | 9.8 | 1.07 | 75.3 | 6.85 | 47 | 0.21 | " | 73 | " | −125 | " |
| Control | | | | | | | | | | | | | | | |
| 1–3 | 80/20/0 | No | 0 | 60 | 8.3 | 0.96 | 70.8 | 7.32 | 15 | 0.09 | Bad | 68 | Not so good | −90 | Not so good |
| 1–4 | A/N'/L' 0/80/20 | No | 0 | 60 | 25.4 | 1.18 | 68.9 | 8.17 | 40 | 2.58 | Very bad | 66 | Very bad | −70 | Very bad |

Note:
1) Talc filler (%): The amount of ash in a dry paper determined according to Japanese Industrial Standard JIS P-8128.
2) Transparency ratio (%) = 100 - value of opacity by Hunter reflectometer (JIS P-8138).
3) Breaking length was measured according to JIS P-8113.
4) Tear factor was determined according to JIS P-8116.
5) Expansion in water was measured with a Fenchel expansion meter after dipping the sheet in water at 20° C for 5 minutes.
6) Workability: workability in the process of conductive treatment and coating of dielectric layer.
7) Heat fixing ability was evaluated by observing the degree of formation of blister in the process of melting the toner by making it contact with a hot plate which is heated at 120° C.
8) Surface potential: The dielectric layer was scanned with a tungsten stylus having a line density of 6 lines/mm under the conditions of stylus pressure at 6 to 12g, rate of scanning at 1m/sec and applied voltage at −600volts. The surface potential was measured 1 minute thereafter.
9) Recorded images were evaluated in the respects of image density, existence of white spots, existence of background, and etc.

The above note for each of the items in Table 1 is also applied to Table 2 to 6.

Table 2

| | Sheet forming | | | | | Properties of transparent paper | | | | | | Properties of electrostatic recording material | | |
|---|---|---|---|---|---|---|---|---|---|---|---|---|---|---|
| | Pulp composition on dry basis | Rosin sizing | Talc filler % | Weight of sheet g/m² | Moisture content % | Bulk density g/cm³ | Transparency ratio % | Breaking length km | Tear factor | Expansion in water % | Workability | Transparency ratio % | Surface potential (Volt) | Recorded images |
| Control Example | B/N/L | | | | | | | | | | | | | |
| 2–1 | 30/55/15 | Yes | 5.1 | 40 | 17.8 | 1.18 | 78.9 | 7.83 | 44 | 0.73 | Good | 76 | −143 | Good |
| 2–2 | C/N/L 30/55/15 | No | 0 | 40 | 16.5 | 1.04 | 74.3 | 7.02 | 45 | 0.32 | " | 71 | −145 | " |

Table 3

| | Sheet forming | | | | | Properties of transparent paper | | | | | | Properties of electrostatic recording material | | |
|---|---|---|---|---|---|---|---|---|---|---|---|---|---|---|
| | Pulp composition on dry basis | Rosin sizing | Talc filler % | Weight of sheet g/m² | Moisture content % | Bulk density g/cm³ | Transparency ratio % | Breaking length lon./lat. km | Tear factor lon./lat. | Expansion in water % | Workability | Transparency ratio % | Surface potential (volt) | Recorded images |
| Example | D/N/L | | | | | | | | | | | | | |
| 3–1 | 25/50/25 | Yes | 0 | 40 | 24.3 | 1.12 | 71.8 | 7.48/5.92 | 42/44 | 0.45 | Good | 68 | −143 | Good |
| 3–2 | E/N/L 25/50/25 | Yes | 0 | 40 | 16.8 | 1.15 | 73.2 | 7.75/6.01 | 41/43 | 0.51 | " | 70 | −141 | " |

Table 4

| | Sheet forming | | | | | Properties of transparent paper | | | | | | Properties of electrostatic recording material | | | |
|---|---|---|---|---|---|---|---|---|---|---|---|---|---|---|---|
| | Pulp composition on dry basis | Rosin sizing | Talc filler % | Weight of sheet g/m² | Moisture content % | Bulk density g/cm³ | Transparency ratio % | Breaking length lon./lat. km | Tear factor lon./lat. | Expansion in water % | Workability | Transparency ratio % | Heat fixing ability | Surface potential (volt) | Recorded images |
| | F/N/L | | | | | | | | | | | | | | |
| Example 4–1 | 8/20/72 | Yes | 6.2 | 50 | 22 | 1.12 | 64.2 | 6.83/5.12 | 38/31 | 1.54 | Good | 61 | Good | −150 | Good |
| 4–2 | 15/20/65 | Yes | 6.4 | 50 | 22 | 1.08 | 67.8 | 7.04/5.54 | 37/32 | 1.37 | " | 65 | " | −148 | " |
| Control 4 | 80/20/0 | Yes | 6.1 | 50 | 22 | 1.09 | 75.3 | 7.54/5.38 | 19/16 | 0.64 | Bad | 72 | not so good | −90 | Bad |

Table 5

| | Sheet forming | | | | | Properties of transparent paper | | | | | | Properties of electrostatic recording material | | |
|---|---|---|---|---|---|---|---|---|---|---|---|---|---|---|
| | Pulp composition on dry basis | Rosen sizing | Talc filler % | Weight of sheet g/m² | Moisture content % | Bulk density g/cm³ | Transparency ratio % | Breaking length km | Tear factor | Expansion in water % | Workability | Transparency ratio % | Surface potential (volt) | Recorded images |
| | G/N'''/L''' | | | | | | | | | | | | | |
| Control 5 | 0/70/30 | No | No | 30 | 25 | 1.07 | 55.3 | 7.30 | 54.0 | 1.60 | Bad | 52 | −70 | Bad |
| Example 5–1 | 20/70/10 | No | No | 30 | 25 | 1.13 | 82.0 | 8.00 | 48.2 | 1.10 | Good | 80 | −130 | Good |
| 5–2 | 30/70/0 | No | No | 30 | 25 | 1.15 | 86.7 | 8.12 | 45.1 | 0.99 | " | 83 | −135 | " |

Table 6

| | Sheet forming | | | | | Properties of transparent paper | | | | | | Properties of electrostatic recording material | | |
|---|---|---|---|---|---|---|---|---|---|---|---|---|---|---|
| | Pulp composition on dry basis | Rosin sizing | Talc filler % | Weight of sheet g/m² | Moisture content % | Bulk density g/cm³ | Transparency ratio % | Breaking length lon./lat. km | Tear factor lon./lat. | Expansion in water % | Workability | Transparency ratio % | Surface potential (volt) | Recorded images |
| | H/N'''/L''' | | | | | | | | | | | | | |
| Control 6 | 0/40/60 | No | 5.2 | 70 | 28 | 1.04 | 45.1 | 6.50/4.32 | 45.1/39.0 | 1.84 | Bad | 42 | −68 | Bad |
| Example 6–1 | 15/40/45 | No | 5.5 | 70 | 22 | 1.11 | 67.6 | 6.97/5.40 | 43.1/38.4 | 1.35 | Good | 65 | −145 | Good |
| 6–2 | 30/40/30 | No | 5.6 | 70 | 18 | 1.15 | 68.7 | 6.85/5.57 | 41.2/37.4 | 1.20 | " | 67 | −142 | " |
| 6–3 | 60/40/0 | No | 5.4 | 70 | 12 | 1.08 | 75.3 | 7.50/5.81 | 37.4/34.0 | 0.78 | " | 73 | −144 | " |

What we claim is:

1. An electrostatic recording material comprising an electroconductive transparentized base sheet having a dielectric layer thereon in an amount within the range of from 3 to 20 g/m² on a dry basis, said transparentized base sheet being obtained by subjecting a fibrous matrix in the form of a sheet mateial to a transparentizing treatment by moistening the sheet material to a moisture content in the range of from 5% to 40% and pressing the resulting moistened sheet with a pressing means having a press surface temperature of at least 130° C, said fibrous matrix consisting essentially of:

a. 6 to 60 parts by weight on a dry basis of synthetic pulp having a microfibril structure and formed of a blended polymer system which consists essentially of 5 to 40% by weight of polyvinyl alcoholacrylonitrile copolymer in which the polyvinyl alcohol component is chemically bonded to acrylonitrile component and the polyvinyl alcohol component content is 20 to 80% by weight, and 60 to 95% by weight of acrylonitrilestyrene copolymer in which the acrylonitrile component content is 5 to 45% by weight; and b. 94 to 40 parts by weight on a dry basis of natural pulp.

2. An electrostatic recording material as defined in claim 1, in which said blended polymer system further includes unreacted polyvinyl alcohol in an amount of 23% or less by weight.

3. An electrostatic recording material as defined in claim 2, in which said blended polymer system further includes an acrylonitrile polymer in an amount of 35% or less by weight.

4. An electrostatic recording material as defined in claim 1, in which said polyvinyl alcohol-acrylonitrile copolymer is a graft copolymer.

5. An electrostatic recording material as defined in claim 1, in which the average degree of polymerization of polyvinyl alcohol in said polyvinyl alcohol-acrylonitrile copolymer is within the range of 500 to 3400.

6. An electrostatic recording material as defined in claim 1, in which the polyvinyl alcohol content in said polyvinyl alcohol-acrylonitrile copolymer is within the range of 20 to 80% by weight.

7. An electrostatic recording material as defined in claim 1, in which the acrylonitrile content in said acrylonitrile-styrene copolymer is within the range of 5 to 45% by weight.

8. An electrostatic recording material as defined in claim 1, in which said fibrous matrix consists essentially of 10 to 50 parts by weight of said synthetic pulp and 90 to 50 parts by weight of natural pulp.

9. An electrostatic recording material as defined in claim 1, in which said natural pulp is wood pulp.

10. An electrostatic recording material as define in claim 1, in which the pressure applied to said sheet material is within the range of 100 to 500 kg/cm.

11. An electrostatic recording material as defined in claim 1, in which the pressure applied to said sheet material is within the range of 120 to 400 kg/cm.

12. An electrostatic recording material as defined in claim 1, having a transparency ratio of more than 50%.

13. An electrostatic recording material as defined in claim 1, in which the amount of the coating for said dielectric layer is within the range of 5 to 10 g/m$^2$ on dry basis.

* * * * *